US008143792B2

(12) United States Patent
Joo et al.

(10) Patent No.: US 8,143,792 B2
(45) Date of Patent: Mar. 27, 2012

(54) LIGHT-EMITTING DIODE BACKLIGHTING SYSTEMS

(75) Inventors: Chulmin Joo, Yongin-si (KR); Hyunick Shin, Seoul (KR)

(73) Assignee: Analog Devices, Inc., Norwood, MA (US)

( * ) Notice: Subject to any disclaimer, the term of this patent is extended or adjusted under 35 U.S.C. 154(b) by 407 days.

(21) Appl. No.: 12/543,722

(22) Filed: Aug. 19, 2009

(65) Prior Publication Data

US 2011/0043118 A1 Feb. 24, 2011

(51) Int. Cl.
*H05B 37/02* (2006.01)

(52) U.S. Cl. ..... 315/185 R; 315/294; 345/102

(58) Field of Classification Search ..... 315/185 R, 315/291, 294, 297, 307, 308; 345/102, 84, 345/204

See application file for complete search history.

(56) References Cited

U.S. PATENT DOCUMENTS

| | | | | |
|---|---|---|---|---|
| 6,271,825 | B1 | 8/2001 | Greene et al. | 345/147 |
| 6,366,270 | B1 | 4/2002 | Evanicky | 345/88 |
| 6,535,190 | B2 | 3/2003 | Evanicky | 345/88 |
| 6,608,614 | B1 | 8/2003 | Johnson | 345/102 |
| 6,717,559 | B2 | 4/2004 | Weindorf | 345/82 |
| 7,001,058 | B2 | 2/2006 | Inditsky | 362/610 |
| 7,064,740 | B2 | 6/2006 | Daly | 345/102 |
| 7,397,205 | B2 | 7/2008 | Huang et al. | 315/360 |
| 7,495,679 | B2 | 2/2009 | Chou | 345/690 |
| 8,058,817 | B2 * | 11/2011 | Lipcsei et al. | 315/297 |
| 2009/0021384 | A1 * | 1/2009 | Jacubovski et al. | 340/653 |
| 2009/0225020 | A1 * | 9/2009 | Ran et al. | 345/102 |
| 2010/0033110 | A1 * | 2/2010 | Chien | 315/294 |
| 2010/0079088 | A1 * | 4/2010 | Lipcsei et al. | 315/297 |
| 2010/0148679 | A1 * | 6/2010 | Chen et al. | 315/185 R |
| 2011/0074839 | A1 * | 3/2011 | Liu et al. | 345/690 |

* cited by examiner

*Primary Examiner* — Don Le

(74) *Attorney, Agent, or Firm* — Koppel, Patrick, Heybl & Philport

(57) ABSTRACT

Lighting system embodiments are provided to energize and calibrate strings of light-emitting diodes. These embodiments are particularly useful for calibration of strings of light-emitting diodes that are arranged to provide backlighting of liquid crystal displays. The systems are structured around the use of a single comparator that is multiplexed to facilitate calibration of a plurality of current sources. The systems can be adapted for use in displays in which different techniques (e.g., "analog dimming" and "pulse-width modulation") are used to vary the brightness of the display. The systems remove the need for special structures (e.g., fuse arrays, special test equipment, and interfaces).

15 Claims, 3 Drawing Sheets

LIGHT-EMITTING DIODE BACKLIGHTING SYSTEMS

BACKGROUND OF THE INVENTION

1. Field of the Invention

The present invention relates generally to backlighting systems for use in displays such as liquid crystal displays.

2. Description of the Related Art

An exemplary application of backlighting is its use in the display of portable electronic devices such as notebook computers, laptop computers, digital cameras, and cell phones. The displays of these devices are generally formed by positioning an array of liquid crystals between a light source and a viewer. Essentially, each of the liquid crystals then act as a variable shutter which passes a selected portion of the light from the light source to the viewer. Each liquid crystal forms one pixel of the display image and command signals to the liquid crystals can then command the generation of various images on the display. Brightness of the display can be controlled via control of the light source.

One light source embodiment for backlighting uses at least one cold-cathode fluorescent lamp (CCFL). CCFLs can be mounted along the edge of the liquid crystals or can be spaced uniformly over the back of the liquid crystals. A more recent light source embodiment for backlighting is formed with multiple light-emitting diodes (LEDs). The number of LEDs required varies with the size of the display. For example, laptop computer displays generally use between 42 and 72 LEDs. The number of LEDs may easily exceed a hundred in other applications. Use of LEDs for the backlighting light source provides a number of advantages which include reduced size, weight, and power, increased brightness, enhanced colors, greater lifespan and elimination of the use of mercury. Although LEDs typically provide a white backlight, they can also be configured to provide other backlight colors.

Calibration of the LED currents is desirable to insure that the backlighting is uniform and thereby pleasing to the eye of an observer. This calibration has typically been accomplished via use of specialized calibration systems formed, for example, with automatic test equipment, arrays of fuses and interface structures.

BRIEF SUMMARY OF THE INVENTION

The present disclosure is generally directed to LED backlighting system embodiments that facilitate current calibration. The drawings and the following description provide an enabling disclosure and the appended claims particularly point out and distinctly claim disclosed subject matter and equivalents thereof.

DETAILED DESCRIPTION OF THE INVENTION

FIGS. 1-4 illustrate lighting system embodiments to energize and calibrate strings of light-emitting diodes. These embodiments are particularly useful for facilitating the calibration of strings of light-emitting diodes (LEDs) that are arranged to provide backlighting of liquid crystal displays in a variety of portable electronic devices, (e.g., notebook computers, laptop computers, digital cameras, and cell phones).

The systems are configured to simplify calibration of string currents so that they are substantially equal to thereby provide equal illumination of all parts of the display. The systems can be adapted for use in displays in which different techniques (e.g., "analog dimming" and "pulse-width modulation") are used to vary the brightness of the display. In a significant feature, the systems remove the need for special structures (e.g., fuse arrays, special test equipment, and interfaces).

Figure 1:
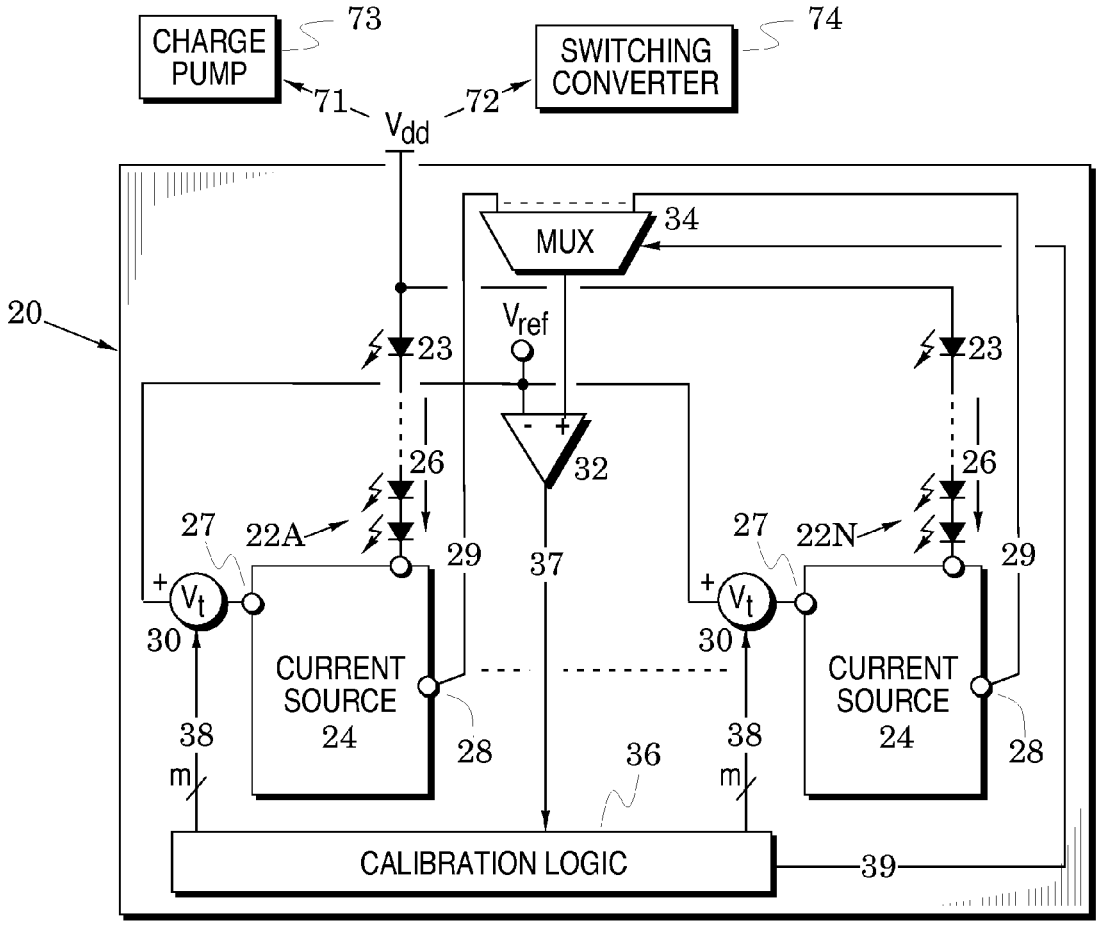
FIG. 1 is a schematic that illustrates a light-emitting diode backlighting system embodiment of the present disclosure.

The systems generally include current sources, control voltage sources, a comparator, and a multiplexer. The current sources are each configured to provide to a respective one of the strings a current having an amplitude responsive to a control voltage and to provide a monitor voltage representative of that amplitude. The control voltage sources are each configured to provide the control voltage of a respective one of the current sources and to vary that control voltage in response to a control signal. The comparator compares a voltage at an input port of the comparator to a reference voltage and the multiplexer is arranged to couple the monitor voltage of any selected one of the current sources to the input port. Accordingly, the output signal of the comparator indicates a calibration state of each of the current sources in response to its respective control voltage In particular, FIG. 1 illustrates a lighting system embodiment 20 that includes strings 22A-22N of light-emitting diodes (LEDs) 23. One end of each of the strings 22 is coupled to a voltage $V_{dd}$ and the other end of each string is coupled to a respective one of a group of current sources 24. Each of the current sources is configured to provide to its respective string 22 a current 26 whose amplitude is responsive to a control voltage at a first port 27. At a second port 28, each current source is also configured to provide a monitor voltage 29 which is representative of the current amplitude. Each of the current sources 24 is further configured to provide a desired value of the current 26 through its respective string 22 of LEDs when the monitor voltage 29 closely approximates a reference voltage $V_{ref}$.

The control voltage of each current source is provided by the combination of the reference voltage $V_{ref}$ and the voltage of a trim voltage source 30. The system 20 also has a comparator 32 to compare a voltage at a first input port to the reference voltage $V_{ref}$ which is provided to a second input port. A multiplexer (MUX) 34 is connected to couple the monitor voltage 29 of any selected one of the current sources 24 to the comparator's first input port. A calibration logic 36 receives an output signal 37 from the comparator 32 and, in response, sends an m-bit signal 38 to control any of the voltage sources 30. The calibration logic also sends another signal 39 to control the multiplexer and thereby couple the control voltage of any of the current sources to the comparator. It is noted that the control voltage applied to each current source is a combination of the reference voltage $V_{ref}$ and the trim voltage $V_t$ of the respective trim voltage source.

Figure 2:
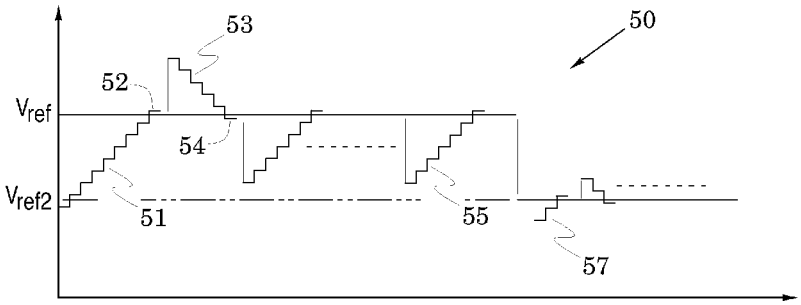
FIG. 2 is a diagram that illustrates monitor voltages during calibration of different current sources in the system of FIG. 1.

A description of operation of the system 20 is facilitated by the graph 50 of FIG. 2 which plots voltage as a function of time. It is initially assumed that the control logic 36 of FIG. 1 has commanded (via the signal 39) the multiplexer 34 to couple the monitor voltage 29 of the first current source 24 (the source coupled to the first LED string 22A) to the comparator 32. The plot 51 in the graph 50 assumes that the monitor voltage (29 in FIG. 1) is initially below the reference voltage $V_{ref}$. Accordingly, the output signal 37 of the comparator 32 is low and, in response, the control logic 36 alters the m-bit signal 38 to step the trim voltage $V_t$ of the trim voltage source 30 upward. Because the plot 51 of FIG. 2 indicates that the monitor voltage is still below the reference voltage $V_{ref}$, the control logic 36 again steps the trim voltage $V_t$ of the trim voltage source 30 upward.

This process is repeated until the monitor voltage 29 of the first current source 24 exceeds the reference voltage $V_{ref}$ as shown at step 52 of the plot 51 of FIG. 2. This causes the output signal 37 of the comparator 32 to change state and, in response, the calibration logic 36 makes no further alteration of the trim voltage of the trim voltage source 30. The current source is configured to provide a desired value of the current 26 through its respective string 22A of LEDs when the monitor voltage 29 approximates the reference voltage $V_{ref}$. Because the desired current through the first LED string 22A has been obtained, calibration of the first current source 24 is now complete.

Accordingly, the calibration logic 36 now alters the signal 39 to cause the multiplexer 34 to couple the monitor voltage 29 of the next current source to the comparator 32 after which the calibration process is repeated. A plot 53 in the graph 50 of FIG. 1 indicates that the monitor voltage of this second current source is initially above the reference voltage $V_{ref}$. Accordingly, the calibration logic 36 successively decreases the trim voltage source of the second current source until the monitor voltage of the second current source again causes the output signal 37 of the comparator 32 to change state. This corresponds to step 54 of the plot 53. Because the desired current through the second LED string 22A has now been obtained, calibration of the second current source is complete. This process is repeated until the current source 24 of the last string 22N of LEDs has been calibrated. The monitor voltage of the current source of the final string 22N is shown as the plot 55 in FIG. 2.

Figure 3:
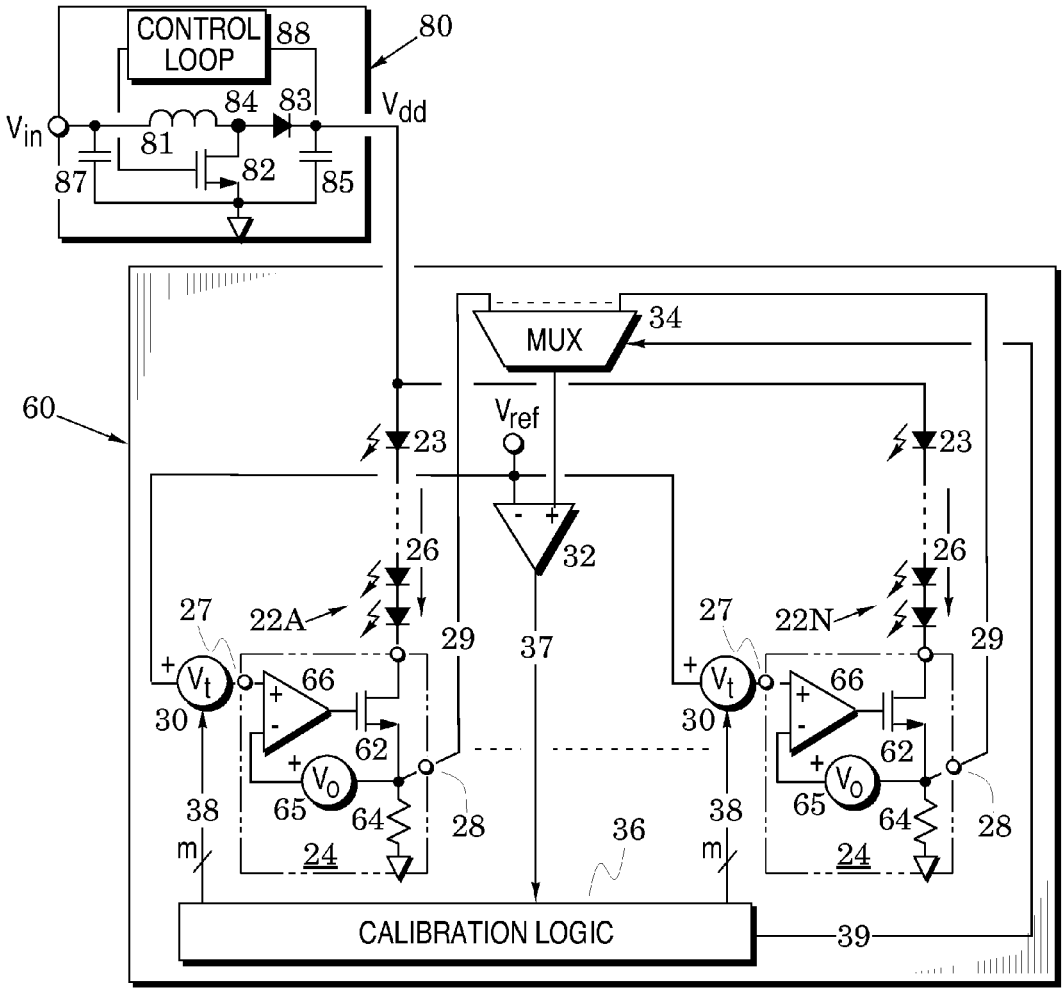
FIG. 3 is a schematic that illustrates another backlighting system embodiment.

An understanding of the lighting system embodiments may be further enhanced by considering the embodiment 60 of FIG. 3 which illustrates a particular embodiment of the current sources 24 of FIG. 1. In this embodiment, a current terminal of a transistor 62 provides the current 26 of a respective one of the LED strings 22. Another current terminal of the transistor is coupled to a resistor 64 and a control terminal is driven by a differential amplifier 66. Although various transistor types can be used in different embodiments of the current source 24 of FIG. 1, the embodiment of FIG. 3 employs a metal-oxide-semiconductor transistor so that the current terminals are a drain and a source and the control terminal is a gate.

A positive input terminal of the differential amplifier is coupled to the trim voltage source 30 while the negative input terminal leads to the top of the resistor 64 and to the second port 28. This forms a feedback loop that includes the negative input terminal of the operational amplifier. When the voltages at the input ports of an ideal differential amplifier are equal, the output voltage will have a predetermined ideal value such as zero. All real differential amplifiers, however, are degraded by an offset voltage $V_o$ which means that the output of the amplifier is zero when the voltages at the input ports differ by the offset voltage. Although this offset voltage is internal to the differential amplifier, it is shown external to the negative input terminal in FIG. 3 to facilitate an understanding of the operation of the current source 24.

If it is initially assumed that the offset voltage $V_o$ is zero so that the voltage $V_t$ of the trim voltage source 30 is also zero and if it is further assumed that the differential amplifier has a large gain, then action of the feedback loop of the current source 24 will cause the difference between the input ports of the differential amplifier to be substantially zero. Thus, the voltage across the resistor 64 is substantially the reference voltage $V_{ref}$ and the current 26 is $V_{ref}$ divided by the resistance of the resistor 64. If the difference between the input ports of the differential amplifier is also zero in all others of the current sources 24, their currents 24 will also be $V_{ref}$ divided by the resistance of the resistor 64. Since substantially the same current flows through all of the strings 22 of LEDs, their brightness will be substantially equal. When the system 20 is used for backlighting a liquid crystal display of a computer, the computer's display will be uniformly lighted.

However, the offset voltage of the amplifier 66 of each of the current sources 24 will generally differ from zero and also differ from the other offset voltages. Without calibration, the brightness of the strings of LEDs will now vary and the lighting of the computer's display will not be uniform. In calibration of the system 60 of FIG. 3, the calibration logic 36 will apply different m-bit codes to the trim voltage source 30 associated with the first current source 24 until the output of the comparator 32 changes state. This process will then be repeated with the multiplexer 34 set to successively present the monitor voltages 29 of others of the current sources to the comparator 32. When this process is complete, the voltage of the trim voltage source 30 will be set opposite and substantially equal to the offset voltage in each of the current sources 24 so that all of the string currents 26 are essentially equal as they are all substantially set to $V_{ref}$ divided by the resistance of the resistor 64 in each current source. The calibration logic 36 can easily be configured to automatically run through this calibration process for all of the current sources 24 and their corresponding strings 22 of LEDs 23.

It is noted that the resolution of the steps in the plots 51, 52 and 55 of FIG. 2 is set by the value of m in the m-bit signals 38 of FIGS. 1 and 3. Increasing the value of m will decrease the voltage difference between the steps so that the difference, after calibration, between the reference voltage $V_{ref}$ and the monitor voltages 28 in FIGS. 1 and 3 will be reduced. The resultant trim code, i.e., the final setting of the m-bit signal, for each current source can be stored in the calibration logic 36.

Returning to the graph 50 of FIG. 2, it is noted that the monitor voltage 28 of FIGS. 1 and 3 (and its corresponding LED current 26) can be reduced to a lower value $V_{ref2}$ to thereby alter the intensity of the light emitted by the LEDs 23 after they are recalibrated to this lower value. Calibration to the lower value $V_{ref2}$ is illustrated in the graph 50 of FIG. 2 with plots such as the plot 57. Because the current sources had been previously calibrated and the stored trim data is thereby available, only a few steps are required in the recalibration.

When the strings 22 of LEDs 23 are used to backlight a liquid crystal display (e.g., in a computer display), this method of varying the display intensity by changing all of the LED currents 26 is generally referred to as "analog dimming". This recalibration to realize a different light intensity is fast and may generally be accomplished during normal display operation, i.e., there is no need for a separate calibration time period before resumption of display operation. Pulse-width modulation (PWM) is another method used for varying the display intensity. In this method, the current 26 through the LEDs 23 is unchanged but is switched on and off at a rate which is varied to thereby vary the intensity. The switching may be accomplished in FIG. 3, for example, by switching the supply voltage to the differential amplifier 66 of each current source 24. In PWM mode, it may be advisable to perform calibration before normal display operation so as to not degrade the display when it is being viewed by a viewer.

The lighting systems 20 and 60 of FIGS. 1 and 3 provide a number of operational advantages. It is noted, for example, that an offset voltage component in the comparator 32 will slightly alter the calibration point where the output of the comparator changes state. This may induce an error in the setting of the monitor voltage 28 (and of the corresponding current 26) of the first current source. This error, however, will also occur in all others of the current sources. The effect is similar to simply moving the reference voltage $V_{ref}$ up or down in the graph 50 of FIG. 2. Because the comparator is used to calibrate all of the current sources, the matching of the string currents 26 is not degraded. If accuracy of the exact value of the string currents is important, this may be enhanced by the use of a precision comparator for the comparator 32 of FIGS. 1 and 3.

Arrows 71 and 72 in FIG. 1 illustrates that the supply voltage $V_{dd}$ of the system 20 can be supplied by various voltage generators such as a charge pump 73 or a switching converter 74. FIG. 3 illustrates that an exemplary switching converter embodiment may be a boost converter 80 that arranges an inductor 81, a switching transistor 82 and a diode 83 to be joined to form a swinging node 84. An output capacitor 85 and an input capacitor 87 are respectively coupled between outer ends of the diode and the inductor and ground. The input capacitor receives an input voltage $V_{in}$ which can be below the supply voltage $V_{dd}$ because of action of the boost converter. Feedback from the output capacitor to the control terminal of the switching transistor completes a control loop 88 that maintains the supply voltage $V_{dd}$.

Figure 4:
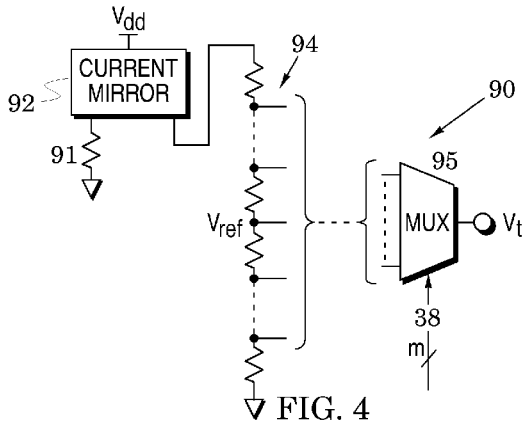
FIG. 4 is a diagram that illustrates a voltage source embodiment in the systems of FIGS. 1 and 3.

Various voltage source embodiments may be used to provide the trim voltage source 30 of FIGS. 1 and 3 (and the associated reference voltage $V_{ref}$). For example, the voltage source 90 of FIG. 4 is formed with a resistor 91, a current mirror 92, a resistor chain 94, and a multiplexer 95. The resistor 91 is coupled to one side of the current mirror to establish a current which is mirrored through the resistor chain 94 by the current mirror. The resistor chain 94 provides the reference voltage $V_{ref}$ and a number of voltages above and below this voltage. The multiplexer 95 can be commanded (e.g., by the m-bit control signal 38 of FIGS. 1 and 3) to provide any of the voltages of the resistor chain as the trim voltage at the first port 27 of the current source 24 of FIGS. 1 and 3. Varying the resistor 91 varies the current mirrored by the current mirror 92 to thereby alter the amplitude of the LED current 26.

The lighting system embodiments of FIGS. 1-4 are especially suited to energize and calibrate strings of light-emitting diodes. In an exemplary use, they facilitate the calibration of strings of light-emitting diodes that are arranged to provide backlighting of liquid crystal displays in a variety of portable electronic devices.

The embodiments of the invention described herein are exemplary and numerous modifications, variations and rearrangements can be readily envisioned to achieve substantially equivalent results, all of which are intended to be embraced within the spirit and scope of the appended claims.

We claim:

1. A lighting system to energize strings of light-emitting diodes, comprising:

current sources each configured to provide to a respective one of said strings a current having an amplitude responsive to a control voltage and to provide a monitor voltage representative of said amplitude;

control voltage sources each configured to provide the control voltage of a respective one of said current sources;

a comparator to compare a voltage at an input port of said comparator to a reference voltage; and a multiplexer arranged to couple the monitor voltage of any selected one of said current sources to said input port;

an output signal of said comparator thereby indicating a calibration state of each of said current sources in response to its respective control voltage.

2. The system of claim 1, wherein said control voltage sources are each configured to vary its control voltage in response to a control signal and further including calibration logic configured to provide said control signal in response to said output signal.

3. The system of claim 1, wherein each of said current sources includes:

a transistor having a control terminal and first and second current terminals responsive to said control terminal wherein said second current terminal is available to provide said current;

a resistor coupled to said first current terminal to provide said monitor voltage; and a differential amplifier arranged to drive said control terminal and having a positive input terminal to receive said control voltage and having a negative input terminals coupled to said resistor.

4. The system of claim 3, wherein said control terminal is a gate and said first and second current terminals are respectively a source and a drain.

5. The system of claim 1, wherein each of said control voltage sources comprises:

a string of resistors to receive a resistor current; and a control multiplexer configured to provide the control voltage adjacent any one of said resistors in response to said control signal.

6. The system of claim 5, further including a current mirror to provide said resistor current.

7. The system of claim 5, wherein said string of resistors is arranged to provide voltages above and below said reference voltage.

8. A lighting system to energize strings of light-emitting diodes, comprising:

current sources each configured to include:

a transistor having a control terminal and first and second current terminals responsive to said control terminal wherein said second current terminal is available for coupling to a respective one of said strings;

a resistor coupled to said first current terminal; and a differential amplifier arranged to drive said control terminal and having positive and negative input terminals with said negative input terminal coupled to said first current terminal;

control voltage sources each configured to provide a selectable control voltage to the positive terminal of the differential amplifier of a respective one of said current sources;

a comparator having a first input terminal and having a second input terminal for reception of a reference voltage; and a multiplexer arranged to couple the first current terminal of any selected one of said current sources to said first input terminal;

an output signal of said comparator thereby indicating a calibration state of each of said current sources in response to its respective trim voltages.

9. The system of claim 8, wherein said control terminal is a gate and said first and second current terminals are respectively a source and a drain.

10. The system of claim 8, further including calibration logic configured to command said selectable control voltage in response to said output signal.

11. The system of claim 8, wherein each of said voltage sources comprises:

a string of resistors to receive a current; and a trim multiplexer configured to provide the control voltage between a selected pair of said resistors.

12. The system of claim 11, further including a current mirror to provide said current.

13. The system of claim 11, wherein said string of resistors is arranged to provide voltages above and below said reference voltage.

14. A method to energize strings of light-emitting diodes, comprising the steps of:

providing to each of said strings a current having an amplitude responsive to a control voltage and further providing a monitor voltage representative of said amplitude;

varying the control voltage corresponding to a respective one of said strings;

comparing a voltage at a comparison port to a reference voltage; and multiplexing the monitor voltage corresponding to any selected one of said currents to said comparison port;

the comparing step thereby indicating a calibration state of the current of each strings in response to its respective control voltage.

15. The method of claim 14, wherein said control voltage is responsive to a control signal and further including the step of varying said control signal in response to said comparing step.

* * * * *